US006860064B2

(12) United States Patent
Bakalar

(10) Patent No.: US 6,860,064 B2
(45) Date of Patent: Mar. 1, 2005

(54) SELECTIVELY POSITIONABLE COVERING ARRANGEMENT

(76) Inventor: Melvin N. Bakalar, 4817 Valleyview Rd., West Bloomfield, MI (US) 48323

( * ) Notice: Subject to any disclaimer, the term of this patent is extended or adjusted under 35 U.S.C. 154(b) by 6 days.

(21) Appl. No.: 10/171,274

(22) Filed: Jun. 12, 2002

(65) Prior Publication Data

US 2003/0070363 A1 Apr. 17, 2003

Related U.S. Application Data

(60) Provisional application No. 60/297,657, filed on Jun. 12, 2001.

(51) Int. Cl.[7] ..... E05D 15/26

(52) U.S. Cl. ..... 49/127; 49/128; 49/63; 49/409; 160/167 R; 160/126

(58) Field of Search ..... 49/61, 62, 63, 49/409, 125, 127, 128, 129, 130; 160/167 R, 200, 205, 220, 118, 126; 16/87 R, 95 R, 87 B

(56) References Cited

U.S. PATENT DOCUMENTS 556,759 A * 3/1896 Lenz et al. ..... 49/128
1,889,112 A * 11/1932 Shoemaker ..... 16/97
2,169,343 A * 8/1939 Kaul ..... 49/127
3,027,606 A * 4/1962 Nicklas ..... 49/260
3,683,100 A * 8/1972 Deal et al. ..... 174/48
3,748,793 A * 7/1973 Tompkins et al. ..... 52/64
4,014,137 A * 3/1977 Williams ..... 49/321
4,141,106 A * 2/1979 Dixon ..... 16/89
4,555,828 A * 12/1985 Matimura ..... 16/95 R
4,642,947 A * 2/1987 Dickson ..... 52/64
4,669,219 A * 6/1987 Tomida ..... 49/130
4,928,450 A * 5/1990 Rutledge ..... 52/202
4,991,257 A * 2/1991 Eutebach ..... 16/87 R
5,016,318 A * 5/1991 Harris ..... 16/95 R
5,224,296 A * 7/1993 Brignon ..... 49/130
5,713,407 A * 2/1998 Judkins ..... 160/89

* cited by examiner

*Primary Examiner*—Gregory J. Strimbu
(74) *Attorney, Agent, or Firm*—The Weintraub Group, PLC

(57) ABSTRACT

A selectively positionable covering arrangement comprises a slotted track member mounted to a vertical wall and extending across the top of an opening in the wall, at least first and second cover members one of which is mounted to the track and relatively laterally slidable between a first position wherein the cover members are coplanar with one another and in parallel juxtaposed covering relation with a respective first and second closure members of the opening and into a second position wherein the cover members are in spaced parallel juxtaposed relation with one another and juxtaposed with one of the closure members whereby to uncover the other of the closure members.

19 Claims, 8 Drawing Sheets

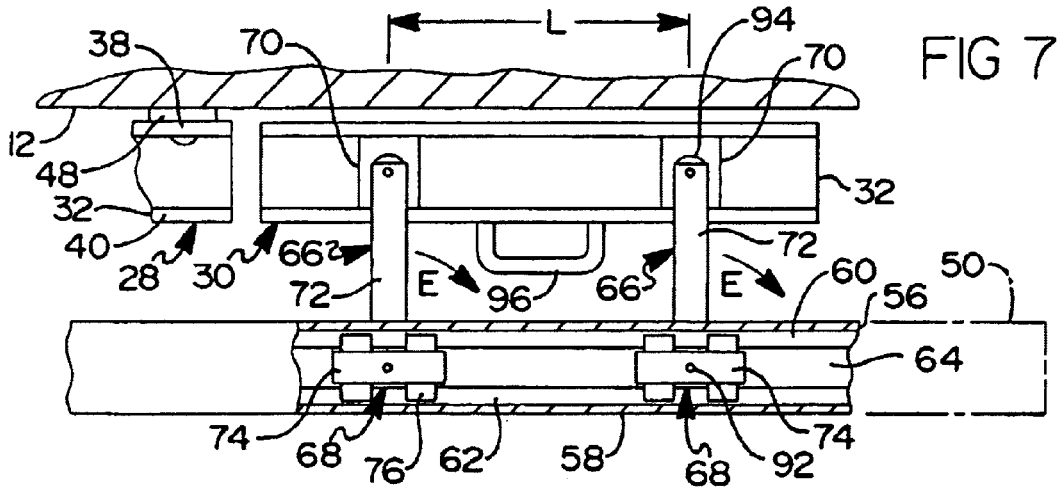
FIG 7
FIG 8
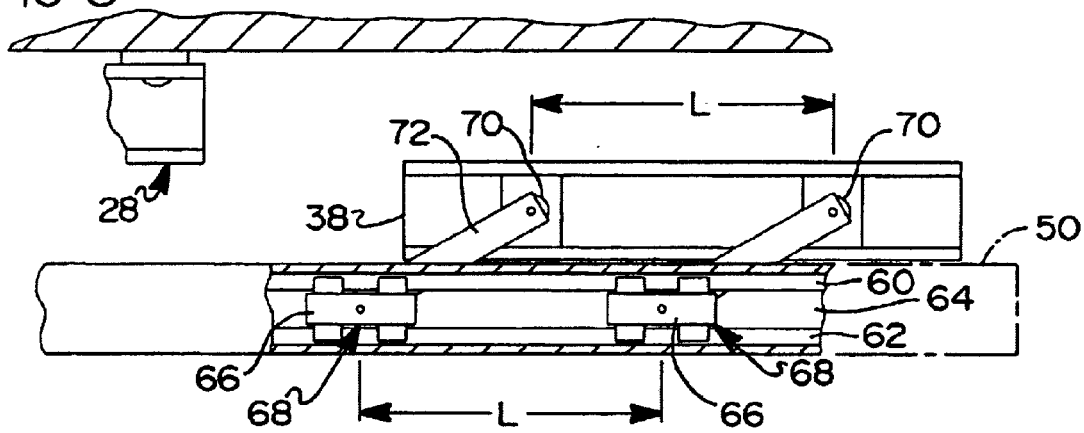
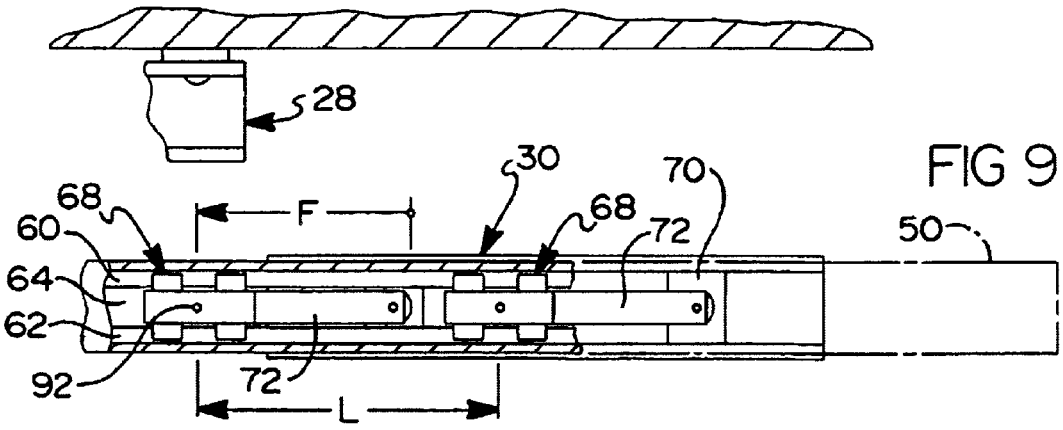
FIG 9

FIG 11
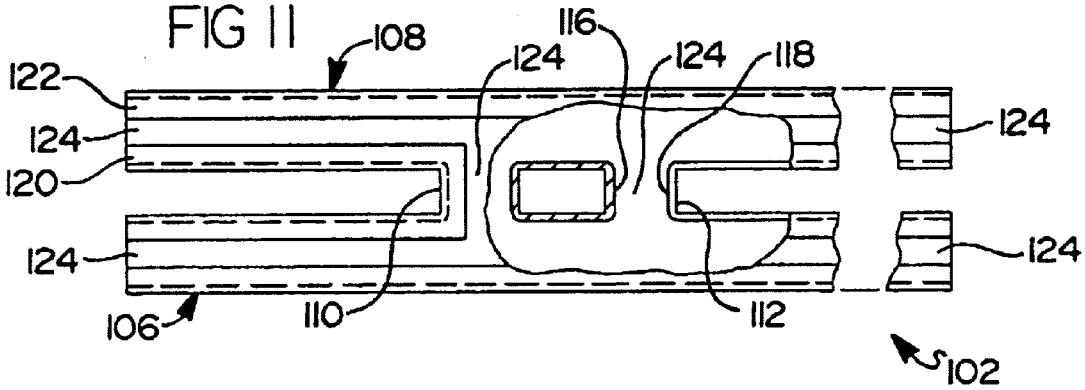
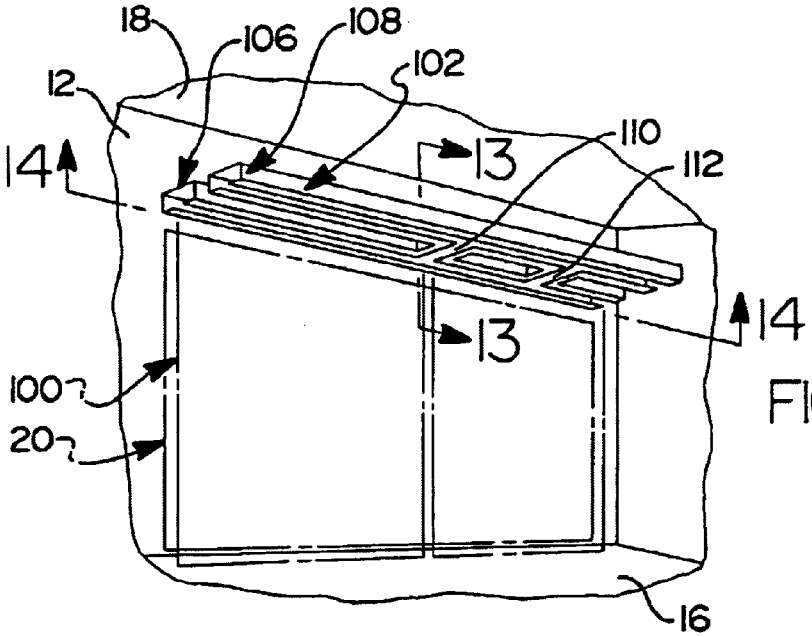
FIG 10
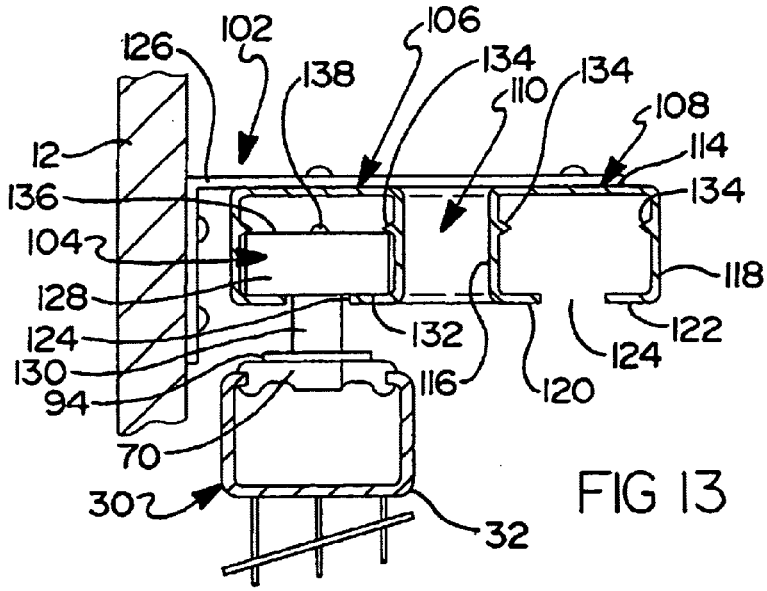
FIG 13

FIG 14
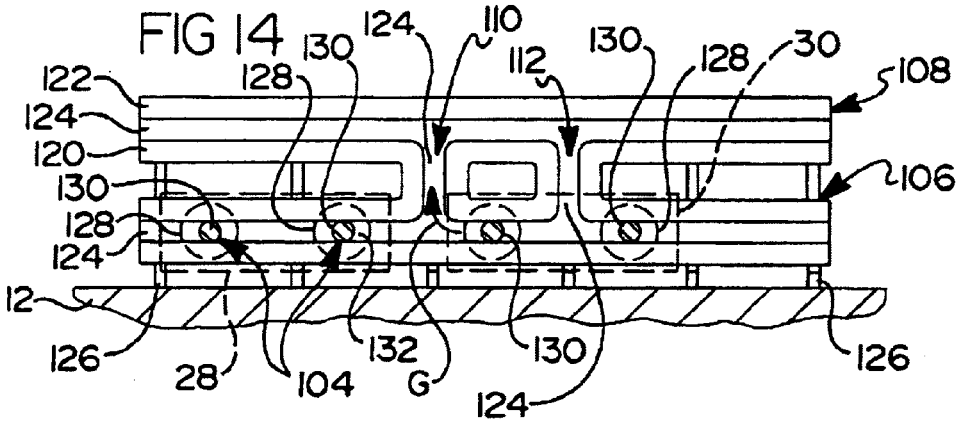
FIG 15
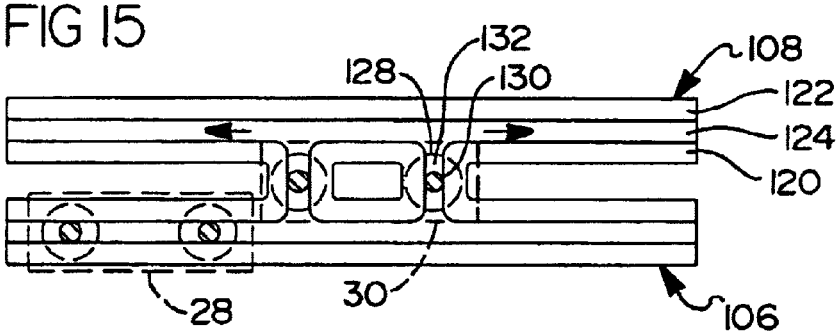
FIG 16
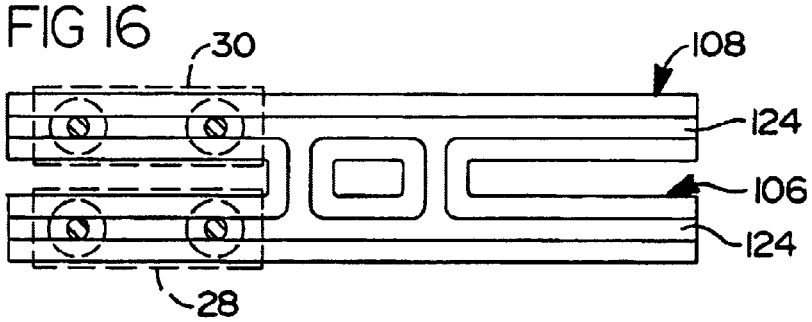
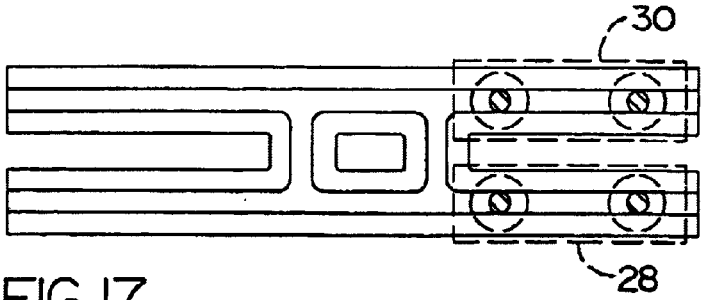
FIG 17

SELECTIVELY POSITIONABLE COVERING ARRANGEMENT

CROSS-REFERENCE TO RELATED APPLICATIONS

This is a completion Patent Application and under 35 USC 119(e) claims a priority date of Jun. 12, 2001, from co-pending United States Provisional Patent Application Ser. No. 60/297,657, the disclosure of which is incorporated by reference.

BACKGROUND OF THE INVENTION

1. Field of the Invention

This invention relates to a covering arrangement for selectively covering and uncovering first and second closure members of an opening such as defined by a window, doorway and the like; in particular, the invention is related to a selectively positionable covering arrangement comprising at least first and second cover members that are relatively laterally slidable between a first position wherein the cover members are coplanar with one another and in juxtaposed covering relation with a respective of the closure members and a second position wherein the cover members are in parallel juxtaposed relation with one another and with one of the cover members whereby to uncover the other of the cover members.

2. Description of Related Art

Windows, patio doors, sashes and frames and/or closure arrangements of the type wherein a first closure member, such as a door or a window, is moved from a first to a second position relative to a second closure member whereby to open or close a window opening, doorway and like opening defined in the mounting frame of the closure members are known.

Depending upon the application, the closure members are generally rectangular, and the opposite horizontal or vertical end portions of the framed closure are mounted in a track of a frame or sash. In operation, at least one of the closure members tilts and/or slides relative to its mounting.

Illustrative closure arrangements are shown in U.S. Pat. No. 2,644,205 to Karp, U.S. Pat. No. 4,662,108 to Duran Romero et al., U.S. Pat. No. 4,669,219 to Tomida, U.S. Pat. No. 4,697,384 to Tutikawa, U.S. Pat. No. 4,829,710 to Schmidt, U.S. Pat. No. 5,287,653 to Young, U.S. Pat. No. 5,542,214 to Buening, and U.S. Pat. No. 5,996,282 to Giovannetti.

While suitable for their respective intended purposes, there is an ongoing need for improvements in enhancing these closure arrangements.

In particular, in some of these closure arrangements, the two closure members comprise two framed windows that slide horizontally between closed and/or open positions. Typically, the user desires to selectively cover and/or uncover these windows, so as to permit light to enter, block off sunlight, or establish privacy, or so as to open the window and permit air to enter.

In yet other closure arrangements, the two closure members comprise two relatively slidable doors of a doorway that slide horizontally to provide an opening, such as that leading to a patio, that enables an occupant to enter or leave the interior of a closed area. In this closure arrangement, the user will typically want to be able to selectively close the opening entirely from outside viewers, partially close the opening such as to change the amount of light entering, and completely uncover a part of the opening defined by the sliding member whereby to permit entry or departure into or from the interior closed by the sliding member.

Accordingly, there is need for a closure arrangement that would enable a user to position a pair of window or door-like cover members in coplanar side-by-side juxtaposed relation with a respective closure member of a pair of side-by-side relatively movable closure members, whereby the cover members block the opening or permit light to enter, and also to move at least one of the cover members into parallel juxtaposed relation with the other cover member and one of the closure members, whereby to expose the other closure member and permit passage through the opening if the other closure member is moved from its closed position.

Desirably, such a covering arrangement would be compact and mountable in close proximity next to the wall containing the opening. The mounting should be efficiently packaged and consume as little space as possible in the requisite mounting while remaining aesthetically pleasing. Further, the covering arrangement should be simple in operation, inexpensive, and use standard and/or conventional components that are readily available in the marketplace.

SUMMARY OF THE INVENTION

It is an object of the present invention to overcome deficiencies in window and door closure arrangements as stated hereinabove by providing a closure arrangement wherein at least a pair of cover members move from a coplanar relation with one another and into a parallel juxtaposed relation with one another.

According to this invention there is disclosed a frame defining a generally rectangular opening such as a doorway (or window) to be closed by first and second door members disposed in generally coplanar side-by-side relation, and a covering arrangement for covering and uncovering the door members of the doorway. The second door is slidable relative to the first door whereby to move between first and second positions wherein the opening of the doorway is, respectively, closed and, at least in part, open whereby to prevent and permit passage therethrough.

The covering arrangement comprises at least first and second cover members, the cover members being of sufficient lateral width to cover a respective door member, and means for mounting and positioning the cover members in either coplanar relation with one another and juxtaposed relation with a respective door member when the door members are in the first position and the doorway is closed, and in parallel juxtaposed relation with one another, at least in part, and with the door members, when the second door member is moved into the second position in juxtaposition with the first door member and the doorway is open, at least in part.

According to a first embodiment of this invention, the means for mounting and positioning comprises:

first means for mounting the first cover member in substantially parallel relation and disposed, at least in part, above the first door member, and second means for mounting the second cover member in substantially parallel relation and disposed, at least in part, above the second door member, the second means for mounting including:

an elongated guide track extending across the top of said door members in substantially parallel spaced relation thereto, and a pair of bracket members for mounting the second cover member for movement between a coplanar and a parallel relation with the first cover member, each bracket member including a link plate having first and second end portions, a roller carriage connected to the guide track for movement between opposite ends of the track and connected to one end portion of the link plate for rotation relative thereto, and a mounting clip fixedly connected to the second cover member and connected to the other end portion of the link plate for rotation relative thereto, the mounting clips being laterally spaced from one another, the connections to the link plates, mounting clips and roller housings cooperate to form a parallelogram support that enables the link plates to locate the second cover member from a coplanar to a parallel relation with the first cover member and the roller housings moving the second cover member into juxtaposition with the first cover member.

In an important aspect of this embodiment, the guide track is generally a tubular member, rectangular in cross-section, and comprising inwardly turned opposed, spaced apart flange or lip portions which define a downwardly open longitudinally extending slot. The roller carriage comprises a generally rectangular block and at least one pair of roller wheels, the block being dimensioned to clearance fit within the slot to constrain the housing for longitudinal movement relative to the track, and the roller wheels being supported on the flanges for rolling movement thereon.

To stabilize and distribute support loads, bending moments and truss forces during axial and rotary movements of the cover member, a respective thrust plate is interposed between the roller carriage and the mounting clip, each thrust plate being secured to the mounting plate by the pin associated with the end portion of each respective link plate.

According to a second embodiment of this invention, the means for mounting and positioning comprises:

a track structure extending across the top of the door members for mounting the cover members in substantially coplanar relation with one another and parallel relation to a respective of the door members when the cover members are in a first position, the track structure comprising:

first and second guide tracks extending across the top of said door members in substantially parallel spaced relation thereto with the second guide track being remote to the first guide track and door members;

first and second transfer guide tracks connecting the first and second guide tracks to one another in parallel spaced apart relation, each guide track having a slot therein with the slots interconnecting with one another to form a slot structure, and a pair of bracket members fixedly connected to each cover member for mounting the cover members in the track structure for movement between coplanar and parallel relation with one another and parallel relation with a selected door member, the bracket member comprising:

a slide carriage disposed in the track structure for slidable movement relative to the guide and transfer tracks, a mounting clip fixedly connected to the cover member, and a stem member, the stem having a first end connected to the slide carriage and a lower end connected to the mounting clip for relative rotation therebetween, the stem having a transverse cross-section slightly smaller than the width of the slot and received within the slot structure to constrain the movement of the cover members between the selected positions.

Preferably and according to this second embodiment, the tracks of the track structure are generally tubular, rectangular in cross-section, and formed to include a downwardly open slot. The slide carriage comprises a head that is generally cylindrical, or disk-shaped and is supported for slidable movement on inturned flanges of the tracks. The stem is generally cylindrical and extends coaxially from the head, the stem fitting through the slot to constrain the head for movement within the tracks.

At least one, and preferably both, of the cover members is movable from the first track via the transfer guide tracks and into the second track, whereby the first and the second cover member may be moved into covering juxtaposed relation with either the first door member or the second door member.

In moving the cover members into the second position, and in a first series of movements, the first and second cover members are initially disposed in the first guide track and positioned so as to be in coplanar relation with one another and juxtaposed relation with the first and second door members. The two head members of the second cover member are aligned with and moved through the transfer tracks and into the second guide track, whereupon the second cover member is in parallel spaced relation to the first cover member and in juxtaposed relation with the second door member. Thereafter, the second cover member may be moved laterally relative to the second guide track into juxtaposed relation with the first cover member, or the first cover member may be moved laterally relative to the first guide track into juxtaposition with the second cover member.

BRIEF DESCRIPTION OF THE FIGURES

The present invention will be more clearly understood with reference to the accompanying drawings. Throughout the various figures, like reference numbers refer to like parts in which:

FIG. 7 illustrates first and second cover members arranged in coplanar relation with one another by a parallelogram support and in parallel covering relation with a pair of respective door members;

FIG. 8 illustrates the arrangement of FIG. 7 and further wherein the parallelogram support enables the second cover member to swing outwardly and away from the second door member;

FIG. 9 illustrates the arrangement of FIG. 8 and further wherein the second cover member is moved laterally (to the left as viewed in the Figure) and into juxtaposition with the first cover member whereby to expose the second door member;

FIG. 10 is a perspective view of a second embodiment of a selectively positionable window covering arrangement according to this invention for covering the lateral sliding doors and doorway shown in FIG. 1;

FIG. 11 is a bottom plan view of a guide track according to this invention and used in the covering arrangement of FIG. 10;

FIG. 13 is an elevation view, taken alone line 13—13 of FIG. 10, showing the mounting bracket and the guide track according to this embodiment of the invention;

FIG. 14 is a plan view taken along line 14—14 of FIG. 10 and shows an arrangement wherein first and second cover members are in coplanar relationship with one another and in spaced covering relation with a respective first and second door member;

FIG. 15 illustrates the arrangement of FIG. 14 and further after the second cover member has swung outwardly and away from the interior wall and away from coplanar relation with the first cover member while remaining in parallel relation with the first cover member;

FIG. 16 illustrates the arrangement of FIG. 15 and further after the second cover member has been moved laterally (to the left as viewed in the Figure) and into parallel juxtaposed relation with the first cover member whereby to expose the second door member;

FIG. 17 is similar to FIGS. 14–16 and show an alternative step wherein the cover members are moved so as to expose the other of the two door members;

DETAILED DESCRIPTION OF THE INVENTION

Figure 1:
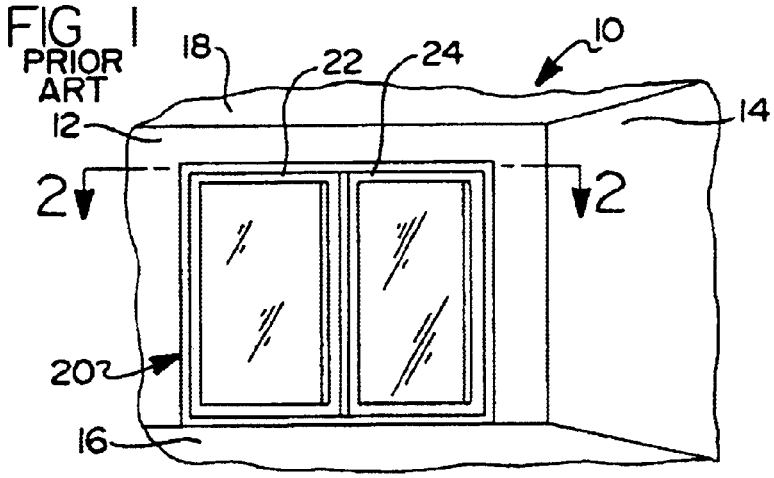
FIG 1 PRIOR ART
FIG. 1 is an environmental front elevational perspective view of a conventional sash or window frame of the type including two laterally slidable generally coplanar doors (or windows) that are to be covered and uncovered by a selectively positionable window covering according to this invention.

Turning now to the drawings, embodiments are shown of an arrangement for covering first and second closure members movably disposed in an opening and in side-by-side relation for movement between open and closed positions. In the illustration shown in FIGS. 1 and 2, there is shown a room 10 of a building, house or other like structure, the room including vertically extending walls 12 and 14, and a floor 16 vertically separated from a ceiling 18. A generally rectangularly shaped door frame 20 is mounted in and forms an opening or doorway in the wall 12. The door frame 20 is conventional and well known in the art and will not be described to any significant degree.

Figure 2:
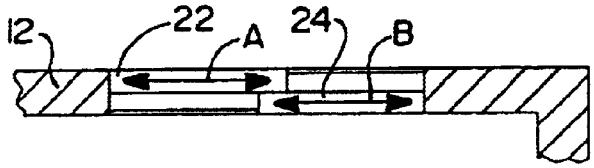
FIG 2 PRIOR ART
FIG. 2 is a view taken along line 2—2 of FIG. 1.
Figure 3:
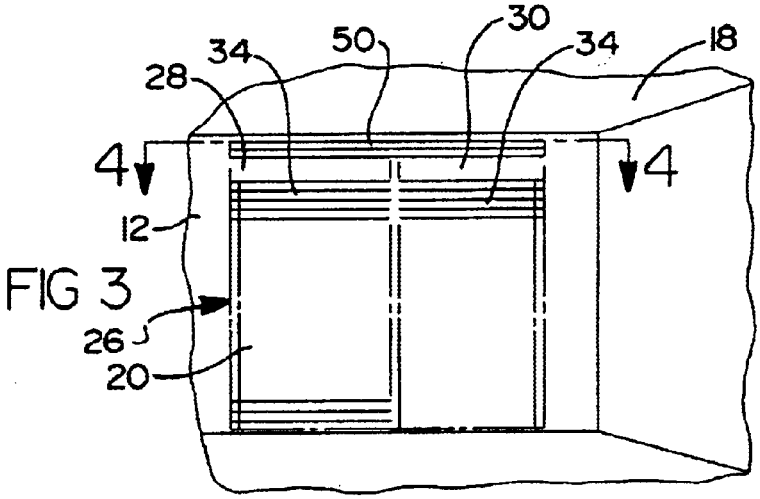
FIG. 3 is a perspective view of a first embodiment of a selectively positionable window covering arrangement according to this invention for covering the lateral sliding doors of FIG. 1.

For the purposes of describing the environment of the invention, the door frame 20 includes conventional track members which mount a pair of rectangularly shaped doors or closure members 22 and 24 in generally side-by-side coplanar relationship for lateral sliding movement between open and closed positions whereby to permit passage therethrough, such as to permit ingress and/or egress to an out-of-doors patio or to let air enter the room. The doors 22 and 24 each include a window to allow light to enter the room or to see outwardly. As shown in FIG. 2, the doors slide in the directions shown by the arrows "A" and "B". It is to be understood that the doorway could also comprise a window or like closable opening.

FIGS. 3–9 and FIGS. 10–17 show two respective embodiments of an arrangement, according to this invention, for covering the doorframe 20 and the two doors 22 and 24. While the covering arrangements in these embodiments are shown as being fastened or otherwise mounted to the wall 12, it is to be understood that they could also be mounted so as to extend downwardly from the ceiling 18 or in conjunction with another wall 14 of the room.

Referring now to FIGS. 3–9, the first embodiment of a covering arrangement according to this invention, generally indicated by the number 26, includes a first and second cover member 28 and 30 for covering a respective door or closure member 22 and 24. Each cover member comprises an upwardly open generally rectangular box or elongated U-shaped channel 32 that is closed at its opposite ends for aesthetic purposes, at least in part, and a window covering element 34 that is intersecured to the channel 32.

The channel 32 comprises a base 36 and a pair of upstanding sidewalls 38 and 40. The sidewalls have opposed end portions 42 and 44 that are inturned and configured to be engaged by a suitable mounting bracket in a manner to be described hereinbelow.

A variety of window covering elements 34 are contemplated for use with the covering arrangement disclosed herein. By way of illustration, and not by way of limitation, the covering elements 34 can be expanded and/or collapsed whereby to completely cover and uncover, or partially cover, the door with which the covering element 34 is associated.

As contemplated herein, the covering element 34 can be vertically expandable and/or laterally expandable. As typified by what are commonly referred to as "Venetian blinds", the covering element 34 may comprise an array of flat parallel slats 46. In such an arrangement, the slats are horizontally coextensive with the door width, vertically separated, and of sufficient number and width to cover the entire vertical length of the respective window. The slats 46 are connected by drawstrings to the base 36 and adapted to be rotated by the drawstrings between a closed position wherein the slats are vertically disposed and overlapped with one another and an open position wherein the slats are horizontally disposed. The covering element may be pulled vertically upwardly towards the base 36 of the channel 32 and vertically "shorten" the door covering, if desired.

The covering element 34 may comprise an array of flat parallel slats (not shown) extending vertically. In such arrangement, the slats are vertically coextensive with the door height, horizontally separated, and of sufficient number and width to cover the entire vertical height of the respective window. The slats are laterally separated and adapted to be rotated by drawstrings between a closed position wherein the slats are overlapping one another and into an open position. The covering element may be pulled laterally of the door to expose, at least in part, the doorway.

Additionally, the covering element 34 may comprise a one-piece curtain of cloth or other suitable opaque material that is vertically extendable and supported at an upper vertical end thereof for downward vertical movement to effect opening and closing. Typical of this window treatment is the so-called "Holland blind" or window shade.

Referring to FIGS. 4 and 7–9, several laterally spaced mounting brackets 48 are used to mount the first cover member 28 in stationary relation to the wall 12. As shown, the mounting bracket 48 secures the sidewall 38 of the channel 32 to the wall 12. In some mounting arrangements, a bracket (not shown) could be used to suspend (i.e., "hang") the channel 32 to the ceiling 18, so as to engage with the upwardly open end portions 42 and 44 of the channel sidewalls.

A support channel or guide track 50 and one or more L-shaped mounting brackets 52 in parallel spaced apart relation are provided to mount the second cover member 30 to the wall 12. As shown, the guide track 50 is fastened to the wall 12 by the brackets 52 such that the guide track 50 is disposed slightly above the door frame 20 and extends thereacross in generally parallel relation to the top of the door frame.

The guide track 50 is generally U-shaped in cross-section and comprises a central base 54 and a pair of sidewalls 56 and 58. The length of the track 50 is dimensioned to be substantially coextensive with the combined lateral width of both of the cover members 28 and 30 as well as to the doors 22 and 24. The L-shaped mounting brackets 52 are laterally spaced along the guide track with one leg of each mounting bracket being secured to the base 54 and the other leg being secured to the wall 12. So mounted, the guide track 50 is downwardly open.

Importantly, each sidewall 56 and 58 terminates in a transverse lip 60 and 62. The two lips are generally flat, parallel to the central base 54 and each extends from its sidewall towards the other sidewall by an amount sufficient that the lips define an uninterrupted longitudinal slot 64 of generally constant width that extends between the opposite ends of the guide track.

Preferably and according to this invention, a pair of like mounting brackets 66 are used to connect the cover member 30 to the guide track 50. The mounting brackets 66 are laterally separated and position the cover member 30 relative to the door frame 20 in such a manner that in a first position (see FIGS. 4 and 7) the cover member 30 is coplanar with the cover member 28 and in parallel juxtaposed relation with the door 24, and substantially simultaneously rotatable and longitudinally movable along the guide track 50 whereby to move the cover member 30 into a second position (see FIG. 9) wherein the cover member 30 is in parallel relation with the cover member 28 and parallel spaced juxtaposition with the door 22.

According to this important feature of the invention, the mounting bracket 66 includes a carriage or roller housing 68 rollably supported for movement within and along the guide track 50, a mounting clip 70 fixedly secured to the cover member 30, and a link plate 72 that connects the roller housing 68 and mounting clip 70 together.

The roller housing 68 comprises a generally rectangular block 74 of polymeric material and includes a pair of flat lateral sidewalls 74*a* and 74*b*, a bottom surface 74*c*, and an upper end portion 74*d*. Two pairs of wheels or rollers 76 are secured by axles to the sidewalls 74*a* and 74*b* for rotation relative to the block 74, the wheels being proximate to the upper end portion 74*d* and at opposite longitudinal ends of the block 74.

The distance between the sidewalls 74*a* and 74*b* of the block 74 is slightly less than the transverse width of the slot 64 the block to enable the housing block to slidably clearance fit within the slot 64. So positioned, the wheels 76 seat on the inturned transverse lips 60 and 62, respectively, of the sidewalls 56 and 58 of the track 50 to permit the roller housing 68 to rollably move therealong. The block 74 and slot 64 constrain the roller housing 68 for longitudinal movement in the guide track relative to the doors 22 and 24.

The mounting clip 70 comprises a pair interfitted relatively movable clip sections 78 and 80, each clip having a first end interfitted with the other clip and an engageable end portion 82 and 84, and a pair of coil springs (not shown) for biasing the engageable end portions of the clip sections away from one another. The clip sections are generally shallow, U-shaped in cross-section, plate members.

The engageable end portions 82 and 84 are configured to interengage, respectively, with the inturned lips 42 and 44 of the channel 32 whereby to secure the mounting clip 70 to the channel 32 of the cover member 30. The end portions 82 and 84 define two respective pairs of oppositely disposed and outwardly open notches dimensioned to interlock with the lips 42 and 44 on the channel 32. The clip sections 78 and 80 are configured to force the coil springs inwardly to enable the notches to be interfitted in a snap-fit within a respective of the inturned lips 42 and 44. So mounted, the mounting clips 70 are fixedly connected to the channel and separated from one another by a distance "L".

The link plate 72 is generally flat, rectangularly shaped, and has first and second end portions 88 and 90 spaced longitudinally. A pair of pins 92 are provided, one pin to connect the end portion 90 to the roller housing 68 and the other pin to connect the end portion 88 to the mounting clip 70. The pin connections enable the roller housing 68 and the mounting clip 70 to rotate independently relative to one another and relative to the link plate 72 and about the respective axes "C" and "D". Desirably, the four pins 92 connect the two link plates 72, the two roller housings 68, and the two mounting clips 70 into a rigid body parallelogram linkage.

Desirably, a flat generally circular thrust plate 94 is disposed between the link plate 72 and the mounting bracket 66 and between the link plate 72 and the housing block 74 of each roller housing 68. Advantageously, the thrust plates 94 operate to stabilize and distribute thrust forces received during axial and rotational movement of the second cover member.

A gripper handle 96 is provided to the second cover member 30 for manually pulling and forcing the cover member outwardly from the wall 12 and laterally along the wall. Preferably, the gripper handle is connected to the sidewall 40 of the upwardly open U-shaped channel 32 to facilitate manual movement of the second cover member 30.

To prevent unwanted removal of the movable cover member 30 from the guide track, a stop member 98 is provided at each end of the guide track. These stop members operate to close the ends of the guide track and engage the roller housings 68 during movement of the cover member in the guide track during door uncovering and covering movements.

Preferably, the stop members comprise decorative end caps or covers which close the end of the channel.

Figure 4:
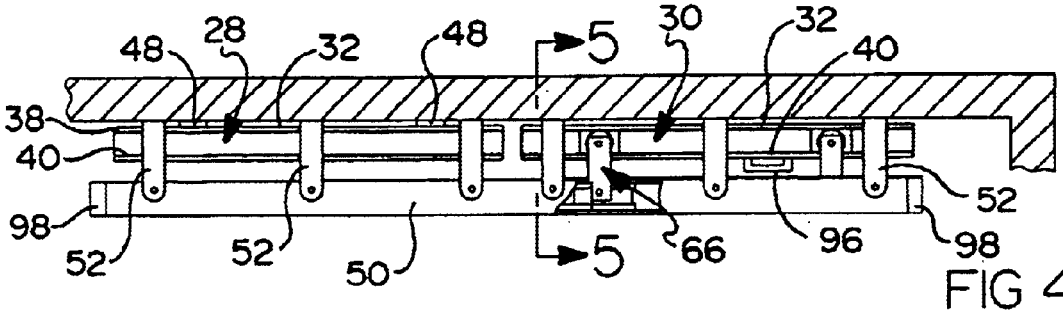
FIG. 4 is a view taken along line 4—4 of FIG. 3 and looking down on the window covering arrangement.
Figure 5:
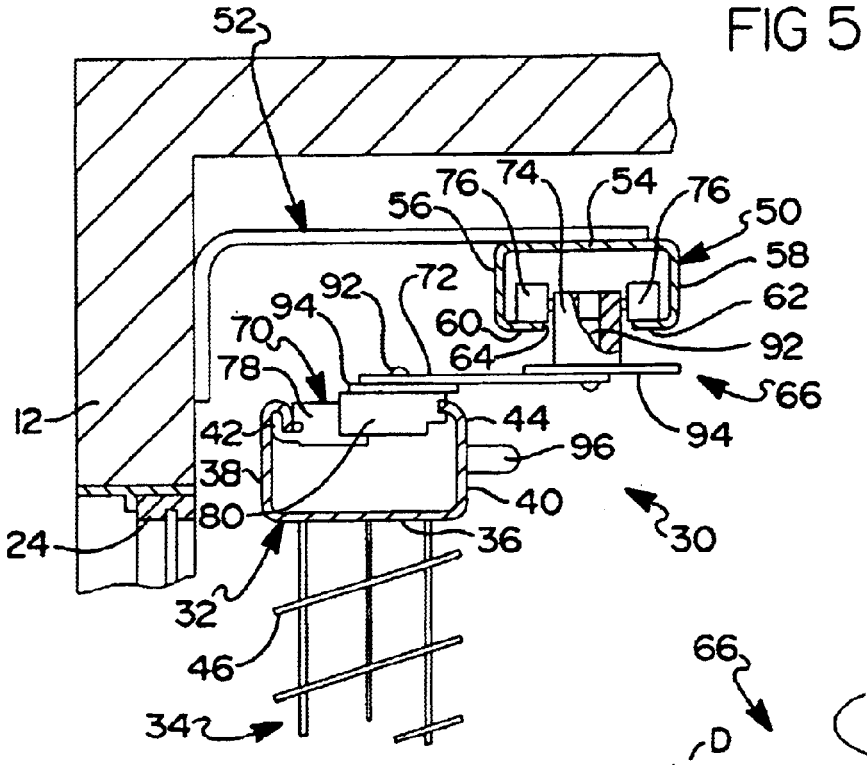
FIG. 5 is a view taken along line 5—5 of the window covering arrangement of FIG. 4.
Figure 6:
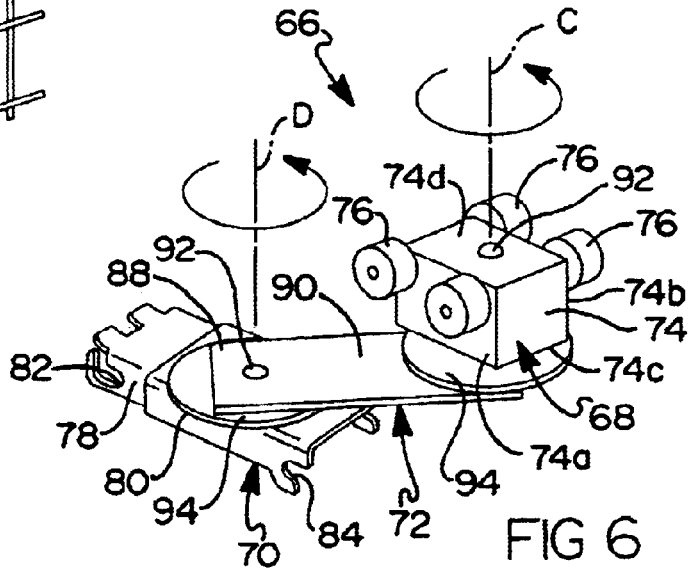
FIG. 6 is a perspective view of a mounting bracket according to this invention and used in the covering arrangement of FIGS. 1–5.

In operation, turning to FIGS. 4 and 7, the mounting brackets 66 are positioned interiorly of the guide track 50 and the stop members 98 placed at the ends of the track. The cover member 30 is positioned adjacent to and snap-fitted into the notched recess portions 82 and 84 formed in the opposite ends of the clip sections 78 and 80. The link plates 72 position the cover member 30 so as to be in coplanar relation with the cover member 28 and parallel juxtaposed relation with the door 24. The pin connections to the mounting clip 70 and roller housings 68 are spaced apart by a distance "L". Initially, the link plates 72 are generally parallel to one another and perpendicular to the longitudinal axis of the guide track 50 and the cover member 30.

Turning to FIGS. 7 and 8, the handle 96 is gripped, causing the cover member 30 and the link plates 72 to rotate in the direction of the arrow "E" and the cover member 30 to move outwardly from the wall 12 and into parallel relation with the cover member 28.

Thereafter, as shown in FIG. 9, the cover member 30 is urged laterally in the direction of the arrow "F" from its initial position and into juxtaposition with the cover member 28, whereupon the door 24 is exposed.

Referring now to FIGS. 10–17, the second embodiment of a covering arrangement according to this invention, generally indicated by the number 100, includes the cover members 28 and 30, a unique track structure 102, and four mounting brackets 104 which are associated with the track structure for selectively positioning the cover members in coplanar and parallel relation with one another. The cover members 28 and 30, mounting clip 70, thrust plate 94, and handle member 96 are as described hereinabove.

The track structure 102 is, preferably, unitary and includes a pair of longitudinally elongated first tracks 106 and 108, and a pair of transverse transfer tracks 110 and 112. The tracks are generally tubular, rectangular in cross-section, and each comprises a top wall 114, a pair of sidewalls 116 and 118, and a pair of lips or flanges 120 and 122 that extend inwardly from a respective sidewall towards one another by an amount sufficient to form a longitudinal slot 124. The slots 124 in the tracks 106–112 of the track structure 102 are configured so as to intersect with one another and form a slot structure for guiding the mounting brackets 104.

A series of L-shaped mounting brackets 126 are used to secure the track structure 102 to the wall 12 whereby the slot 124 formed in each of the tracks 106, 108, 110 and 112 is facing the floor 16. The mounting brackets 126 are laterally spaced from one another and each has one leg thereof secured to the top walls 114 of the tracks 106–112 and the other leg thereof secured to the wall 12. If desired the mounting bracket 126 could be otherwise, such as being adapted to hang the track structure from the ceiling 18.

Figure 12:
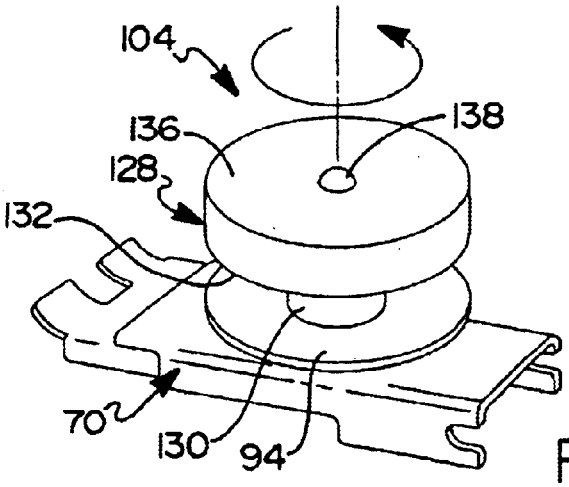
FIG. 12 is a perspective view of a mounting bracket according to this invention and used in the covering arrangement of FIG. 10.

According to this invention, referring to FIG. 12, the mounting bracket 104 comprises a thick generally cylindrical head 128, and the mounting clip 70 described hereinabove, form a rod-like or cylindrical stem 130. The head 128 has a diameter slightly less than the distance between the sidewalls 116 and 118 of the tracks 106–112 with the underface 132 of the head portion being adapted to be supported on the flanges 120 and 122 for gliding or sliding movement therealong. Preferably, the cylindrical head 128 is comprised of a self-lubricating polymeric material. Further, the interior longitudinally extending sidewall of each track 106–112 is provided with a longitudinally extending V-shaped rib 134. The ribs are spaced from the flanges 120 and 122 by an amount to enable the ribs 134 to engage the upper face 136 of the head and captivate the head 128 therebetween. The inwardly extending ribs 134 cam the head 128 toward the flanges 120 and 122 and position the stem 130 relative to the slot structure to inhibit any possible wobble of the head and thereby stabilize the longitudinal movement of the head within the tracks.

The stem portion 130 has one end thereof integrally formed with the head 128 and the other end thereof are connected to the mounting clip 70 by a pin 138 to enable relative rotation therebetween. The diameter of the stem 130 is slightly less than the width of the slot 124 and is adapted to constrain the mounting bracket 104 for movement therewithin.

Further, a thrust plate 94 is positioned between the top of the mounting clip 70 and the free end face of the stem 130 to stabilize movement of the cover member relative to the track structure 102.

Preferably, the lip portions 120 and 122 that form the change in direction of the slots 124 between the tracks 106 and 108 and the transfer tracks 110 and 112 are slightly rounded. Importantly, these lips engage the cylindrical body of the stem portion 130 and enhance smooth movement of the cover members within and between the tracks 106–112.

In operation, referring to FIGS. 14 and 15, two mounting brackets 104 are secured to each cover member 28 and 30. and the cover members inserted into opposite end portions of the guide track 106. The first cover member 28 is fixedly connected to a first pair of mounting clips 70 and positioned in parallel juxtaposed relation to the door 28 in one end portion of the track 106. The second cover member 30 is fixedly connected to a second pair of mounting clips 70 and positioned in coplanar relation with the first cover member 28 and parallel juxtaposed relation to the second door 30 in the opposite end portion of the track 106.

In such mounting, the two mounting clips 70 associated with each respective cover member are spaced apart by an amount "L". The respective head portions 128 are mounted for sliding movement within the track with the ribs 134 engaging the top face 136 and urging the lower face 132 into engagement with the flanges 120 and 122 and the stems 130 are disposed in the slot structure. The geometrical axis through the head and stem portions 128 and 130 is generally perpendicularly disposed relative to a plane extending through the guide track structure 106–112.

The handle 96 on the second cover member 30 is gripped and the second cover member moved in the direction of the arrow "G" so as to be manually pulled outwardly from the wall 12 and positioned within the transfer tracks 110 and 112. At this point, the cover member 28 is in parallel juxtaposed relation with the door 22 and the second cover member 30 is in parallel spaced relation to the two door members 22 and 24 and the cover member 28.

Thereafter, if desired, and shown in FIG. 16, the second cover member 30 may be moved into the track 108 and laterally thereto so as to be in juxtaposition with the first cover member 28 and the first door 28, thereby exposing the second door 30.

Alternatively, if desired, and shown in FIG. 17, the second cover 30 may be moved into the track 108, in juxtaposed relation to the second door 24, and the first cover member 28 may by moved laterally relative to the track 106 to be in interposed juxtaposed relation between the first second door 24 and the second cover member 30, thereby permitting the first door 22 to be accessed.

Figure 18:
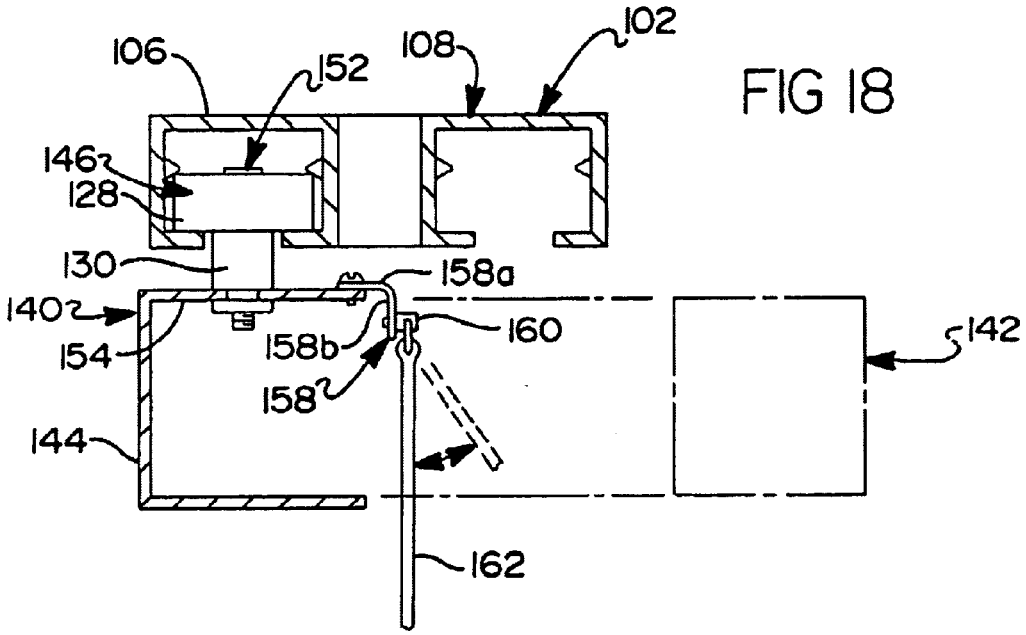
FIG. 18 is a section view of a third embodiment of a selectively positionable window covering arrangement using the track structure of FIGS. 10–17 according to this invention and illustrating, partially in section, a mounting bracket mounting a window cover member to the track structure.
Figure 19:
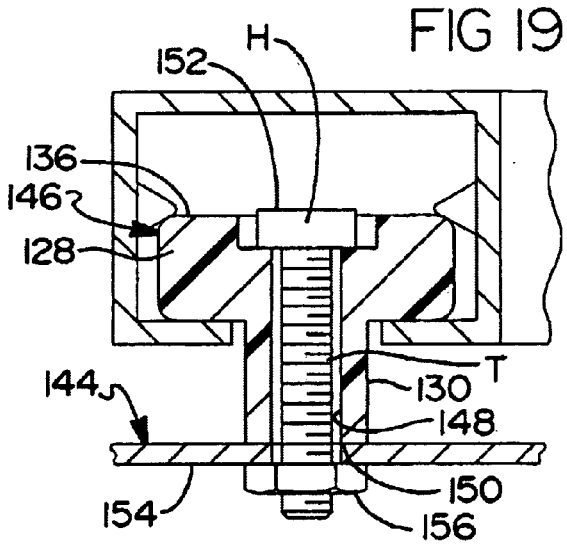
FIG. 19 is an enlarged view of the mounting bracket mounting a window cover member to the track structure shown in FIG. 18.
Figure 20:
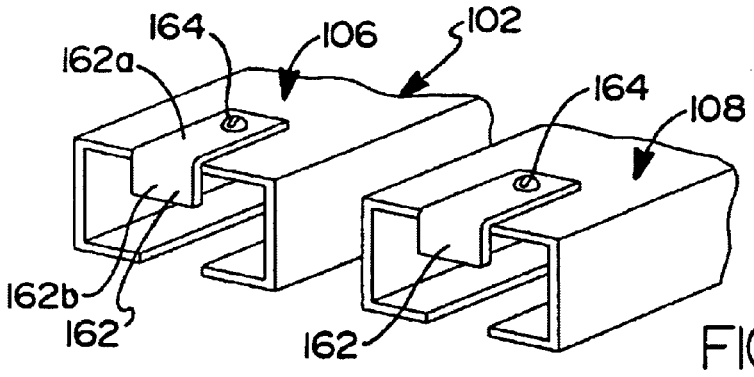
FIG. 20 is a perspective view showing stop members provided at one end of the track structure shown in FIG. 18.

Further, and as illustrated in FIGS. 18–20, a selectively positionable window covering arrangement according to this invention would include the track structure 102 and a mounting bracket 140 to mount a window cover 142 to the track structure. The window covers 30 discussed herein above comprised an upwardly open U-shaped channel member and the window covering treatment extended from the bottom of the channel. While U-shaped, the end portions of the channel could include rigidifying plates that would in effect form a square or generally rectangularly shaped box-like structure.

According to this aspect of the invention, the mounting bracket 140 is provided for connecting the window cover 142 to the track structure 102. The mounting bracket 140 includes a generally C-shaped channel 144, and a mounting member 146. The channel 144 is outwardly open and dimensioned to receive the window cover 142 inserted therewithin in a friction fitment. The, top, back and bottom legs of the channel 144, respectively, are typically 1½"×2"×⅝" to accommodate standard window covers, or 1½"×1½"×⅝" to accommodate low profile window covers. However, the cross-section of the channel 144 would change as regards the cross-section of the window cover to achieve the friction fitment.

The mounting member 146 comprises the mounting bracket 104 (shown in FIG. 12), the mounting member 146 being integrally formed of a polymeric material to include a cylindrical head 128 and an axially elongated cylindrical stem 130. Preferably, the corner edges of the head 128 would be slightly rounded to enhance sliding engagement with the track. A bore 148 extends through the mounting member 146 from the top surface 136 of the head to the bottom surface 150 of the stem, the bore being aligned with the central geometrical axis of the body and sized to receive a threaded fastener 152. In some applications, the top surface 136 of the head 128 would be provided with a recess to receive and flush-mount the head H of the fastener 152. The threaded end portion T of the fastener H is adapted to threadably connect to the top leg 154 of the channel 144. Preferably, a lock nut 156 would threadably engage with the end portion T of the fastener and force the top leg 152 against the bottom surface 150 of the stem 130, preventing relative rotation between the stem 128 and the channel 144.

As shown in FIG. 18, an L-shaped bracket 158 has a first leg 158*a* connected to the top surface of the top leg 154 of the channel 144 and a second leg 158*b* extending downwardly therefrom. Preferably, the leg 158*a* would be connected to the channel by a conventional threaded fastener 160, although the leg 158*a* could be integrally formed therewith. Desirably, the leg 158*b* is used to enable a wand or like member 162 to be attached thereto, whereby to enable the user to pull or otherwise maneuver the window cover relative to the track structure.

Further, as shown in FIG. 20, a stop member 162 is provided at the end of each track 106 and 108 to engage and prevent escape of the head 128 therefrom. In the embodiment shown the stop member 162 is in the form of an L-shaped bracket and has a first leg 162*a* connected to the top surface of the track and a second leg 162*b* extending into partial covering relation with the track open end. Preferably, the leg 162*a* would be connected to a respective track by a conventional threaded fastener 164. It should be appreciated that the closure may be other, such as provided by a closure cap, or a retention leg extending from another portion of the track member 106 or 106.

Desirably, to simplify installation, a pair of alignment indicia are provided, one being provided on the C-channel 144 and the other on the cover 142. Such alignment indicia, when aligned with one another, help locate the cover 142 relative to the channel, and position the glide heads 128 so as to be proximate the ends of the track members.

Figure 21:
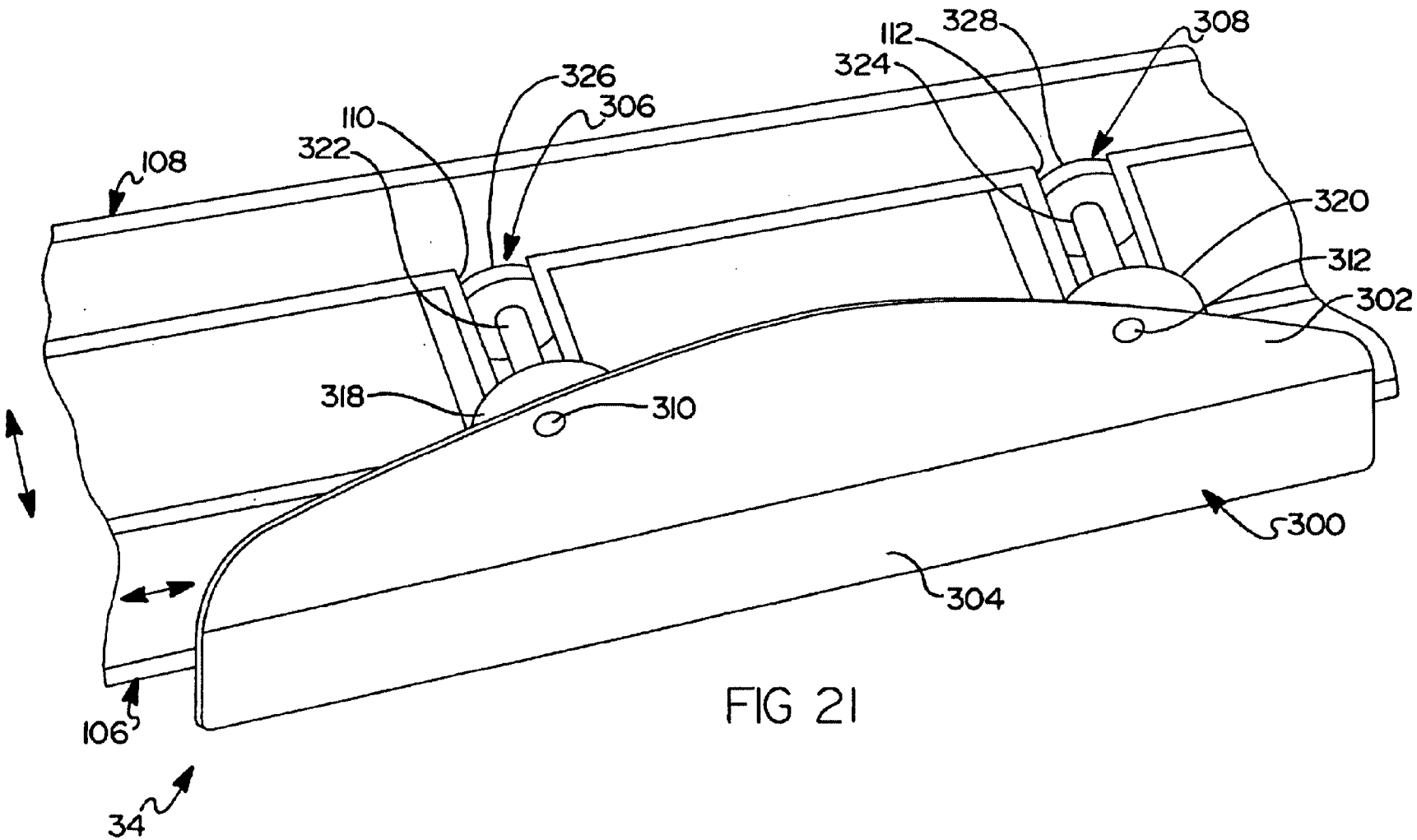
FIG. 21 is a partial perspective view of a third embodiment hereof.
Figure 22:
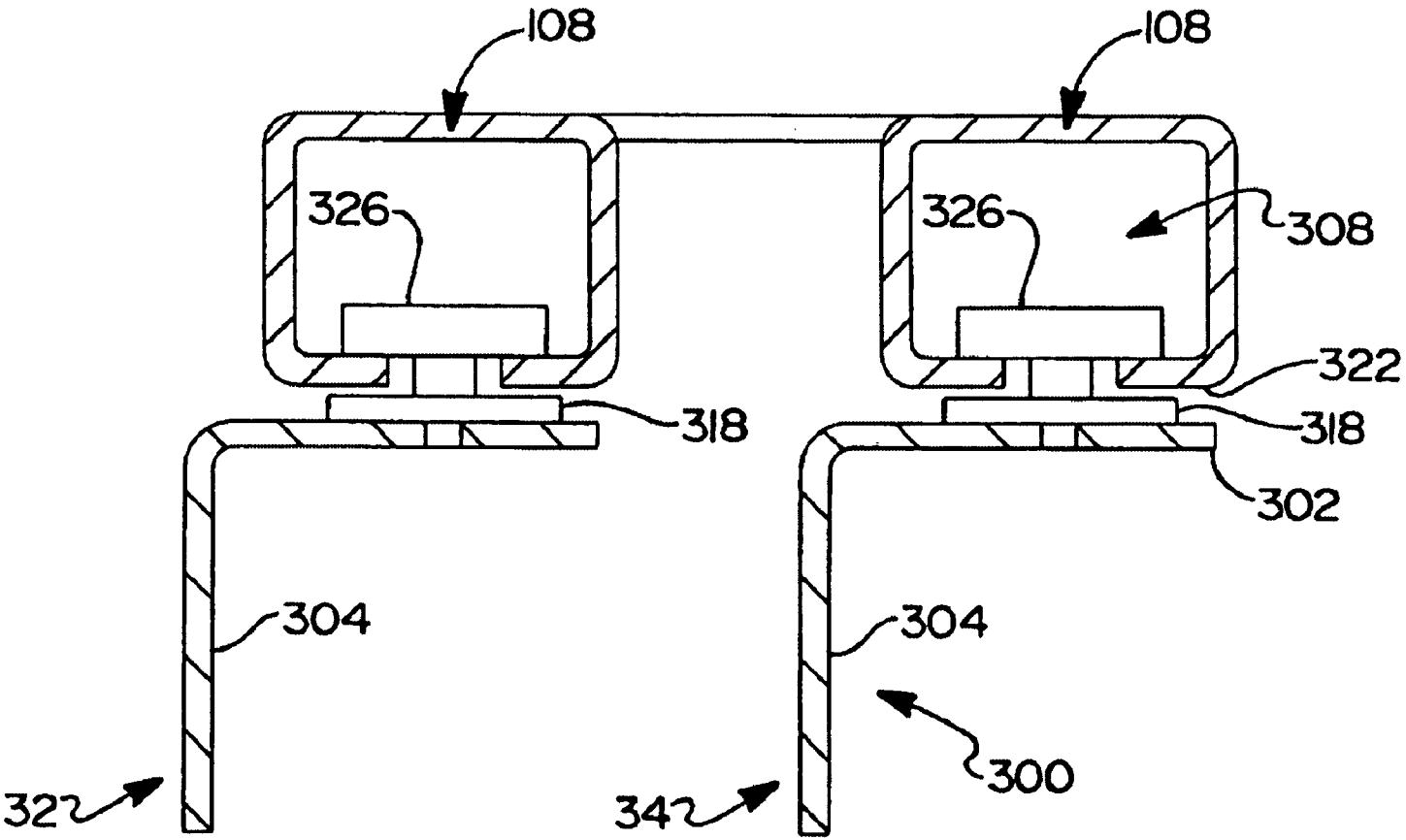
FIG. 22 is a partial cross-sectional view of the third embodiment hereof.

In a further embodiment hereof, and as shown in FIGS. 21 and 22, there is provided a cover member 34 having securing bracket 300 which generally comprises a substantially L-shaped member having a first leg 302 and a second leg 304 disposed substantially normal thereto. The cover member 34 is secured or otherwise mounted to the bracket 300 in the manner as described hereinabove.

As shown, a pair of spaced apart spools 306, 308 are each secured to the leg 302 by a suitable pin 310, 312, respectively, or the like, each pin defines on for its associated spool to enable the spools to rotate therearound. The spools and bracket arrangement is optimally adapted for use with the track transverse track array shown in FIG. 10, above, as described hereinbelow.

As shown, each spool 306 or 308 comprises a first disc 318, 320 of a first diameter disposed exteriorly of the track and a reduced diameter medial portion 322, 324, respectively, and an enlarged diameter interior disc 326, 328. The discs 318, 320 are slideably movable along the length of the track exteriorly of the channel or slot. Each reduced diameter medial portion 322 and 324 and interior disc 326 and 328 are disposed within and slide in its associated track, as shown, and are moveable into the transverse tracks 110, 112 to translate the cover member from the track 106 to the track 108.

Similarly, a second cover member 341 is translatable and the track 106, as described hereinabove, one the cover member 30 vacates the track 106 (FIG. 22).

Although not shown, it is further contemplated that there be a further section of cover member which is stationarily disposed or fixed in the track 106 and which covers a third panel or door.

From the above, it is readily appreciated that there has been described herein an improved cover assembly for door walls and windows which enhance aesthetic while concomitantly controlling the amount of light entering therepast.

Having, thus, described the invention, what is claimed is:

1. A selectively positionable arrangement for covering a wall opening, comprising:

a track structure adapted to extend across the top of the opening, said track structure comprising:

a first elongated track, said track having opposite ends and a first elongated slot extending between the opposite ends thereof, a second elongated track, said second elongated track having opposite ends and a second elongated slot extending between the opposite ends thereof, said first and second elongated slots being disposed substantially parallel to and spaced from one another by a first distance, a first transverse track, said first transverse track having a first transverse slot formed therein open to and extending between the first and second elongated slots formed in the first elongated track and the second elongated track, and a second transverse track, said second transverse track spaced from the first transverse track and having a second transverse slot formed therein open to and extending between the elongated slots formed in the first and second elongated tracks, said first and second transverse slots being disposed substantially parallel to and spaced from one another by a second distance, a first cover member, said first cover member comprising:

a first bracket member, means for connecting the first cover member to the first bracket member, and first means for interconnecting the first bracket member to the track structure and for movement in the slots of the track structure, the slots enabling the to sequentially move the first cover member from the first track simultaneously through the first and second transverse tracks, to the second elongated track, and a second cover member, said second cover member comprising:

a second bracket member, second means for interconnecting the second bracket member to the track structure and for movement in the slots of the track structure independently of said first means the slots enabling the second means to sequentially move the second cover member from the first track, simultaneously through the first and second transverse tracks, to the second elongated track, wherein the first and second cover members are movable between a coplanar relation with one another and a parallel juxtaposed relation with one another, and at least one of the cover members is vertically collapsible.

2. The arrangement of claim 1 wherein each of said first and second means for interconnecting comprises;

a pair of spaced apart spools, secured to a respective one of said first and second bracket members and separated by the second distance defined between the transverse slots in the transverse tracks, each spool including a disc supported for sliding movement atop an associated one of the tracks, and a reduced diameter medial portion, each medial portion being constrained for movement within the slot of the associated one of said tracks.

3. The covering arrangement of claim 1 wherein said track structure is unitary and generally disposed in a horizontal plane adapted to extend perpendicularly outwardly and away from said wall opening, and each bracket member comprises a C-shaped channel member, each said C-shaped channel member being adapted to receive a respective one of said cover members to hang the cover member.

4. The covering arrangement of claim 1, wherein said opening comprising:

said track structure mounting the first and second cover members in substantially parallel vertical side-by-side relation and adapted to be disposed, at least in part, above a respective first and second door member of the wall opening.

5. A covering arrangement for selectively covering first and second closure members disposed in a frame of an opening for movement between open and closed positions, the covering arrangement comprising:

an elongated guide track having opposite ends and adapted to extend substantially the entire lateral width of said first and second closure members when in said closed positions, means for supporting the guide track across the top of the frame so as to extend away from the frame, a first and a second cover member for covering a respective closure member, means for supporting the first cover member from said guide track and in covering relation to said first closure member, means for supporting the second cover member from said guide track and selectively positioning the second cover member, in juxtaposition with either of said first and second closure members when said closure members are in either of said open and closed positions, said means for supporting and selectively positioning comprising:

means for constraining the second cover member to move between a first position, coplanar to said first cover member, and a second position, parallel to said first cover member with at least a portion of said second cover member overlapping a portion of said first cover member, said second cover member moving in a direction generally perpendicular to a major face of said first cover member with said second cover member generally parallel to said first cover member when moving between said first and second positions, and at least one of said cover members being vertically collapsible.

6. The covering arrangement as claimed in claim 5, wherein said means for constraining comprises a pair of support brackets, each support bracket including:

a roller housing rollably secured to said guide track for axial rollable movement relative thereto and between the opposite ends of the guide track, a mounting bracket fixedly secured to said second cover member, and a link plate connecting the roller housing and the mounting bracket together, said link plate having a first end pin connected to the roller housing and a second end pin connected to the mounting bracket, the link plate being adapted to rotate relative to the pin connections.

7. The covering arrangement as claimed in claim 6, wherein said second cover member is vertically expandable and collapsible for covering and uncovering said second closure member when the second closure member is disposed in either of said open and closed closed position.

8. The covering arrangement as claimed in claim 6, wherein said guide track comprises a longitudinally elongated channel of U-shaped cross-section, said U-shaped channel opening downwardly and each leg of the U-shaped channel terminating in a transverse lip whereby to narrow the channel opening and-define an elongated slot that extends between the opposite ends of the track, and each said roller housing comprises a housing member and a roller, the rollers being mounted for rotation to the roller housings and seating on the lips of the channel, and the slot receiving a portion of each of the roller housing members therein.

9. The covering arrangement as claimed in claim 8, further wherein a thrust plate is disposed between the housing member and the link plate of each said support bracket, the thrust plates operating to stabilize and distribute thrust forces received during movement of the second cover member.

10. The covering arrangement as claimed in claim 9, further wherein a thrust plate is disposed between the mounting bracket and the link plate of each said support bracket the thrust plates operating to stabilize and distribute thrust forces received during movement of the second cover member.

11. The covering arrangement as claimed in claim 8, wherein each said mounting bracket includes two ends each including a pair of oppositely disposed outwardly opening notches, and said second cover member comprises an upwardly open channel of U-shaped cross-section, said upwardly open channel terminating in inwardly directed lips, the lips being adapted to interlock with the notches.

12. The covering arrangement as claimed in claim 11, wherein each said mounting bracket comprises a pair of bracket sections, the bracket sections each having a rear end and forward end each formed with a respective one of the pairs of said notches, and biasing means for biasing each respective pair of the sections away from one another, interlocking fitment between the notches and.

13. The covering arrangement as claimed in claim 6, wherein the first and second cover members each comprise an array of parallel slats arranged horizontally, said slats being vertically separated and adapted to be moved between a closed position and an open position.

14. The covering arrangement as claimed in claim 6, further comprising a gripper handle, said handle being connected to said second cover member to facilitate manual movement of the second cover member.

15. The covering arrangement as claimed in claim 6, further comprising means connected to said second cover member for enabling a user to manually grip and move the second cover member.

16. In combination, a vertical wall including a frame, said frame including an opening, first and second door members disposed in said frame in generally side-by-side parallel relation, the first door member being movable horizontally relative to the second door member and between first and second positions, and a covering arrangement for covering the door members, said covering arrangement comprising a support track, means for mounting the support track to the wall, said mounting means positioning the support track above and across the top of the frame and extending outwardly and away from said wall, and first and second cover members, and means for mounting at least one of the cover members in said support track for movement therewithin and between first and second positions, the first position positioning the one cover member in juxtaposition with and overlapping a respective door member with the two cover members in coplanar relation with one another, and the second position positioning said one said cover member in parallel relation with and partly overlapping cover member, the one cover member moving in a direction generally perpendicular to a major face of said other cover member with said one cover member generally parallel to said other cover member when moving between said first and second positions, and the one cover member being vertically collapsible.

17. The combination as recited in claim 16, wherein said support track is unitary and includes a pair of first slots disposed in parallel spaced relation with one another and a pair of second slots disposed in parallel spaced relation with one another and transverse to said first slots, said first slots extending between opposite lateral ends of the frame and said second slots being disposed between said lateral ends and interconnecting the said first slots, said means for mounting the one cover member in said support track for movement therewithin comprises a pair of mounting brackets fixedly secured to a top portion of said one cover member, a pair of disc housings, and each disc housing including a stem and a shaped disc, each said stem having a medial portion and opposite ends, respectively, connected to a respective one of said mounting brackets and to a respective one of said shaped discs, each said shaped disc being adapted to slide atop the support track and relative to opposite ends of the support track.

18. The combination as recited in claim 16, further wherein said support track is elongated and has opposite ends, the support track being dimensioned such that the opposite ends are proximate to opposite lateral ends of the frame when the track is mounted to the wall, and wherein a slot extends between the opposite ends of the support track, and said means for mounting the one cover member in said support track for movement therewithin comprises a pair of roller housings, each said roller housing including a housing portion disposed within said slot and a set of rollers for enabling rolling movement of the roller housing relative to the opposite ends of the support track, a pair of mounting brackets fixedly secured to a top edge of each said cover member, and portion of said one cover member, and a pair of link plates each associated with a respective roller housing for moving the one cover member between said first and second positions.

19. A selectively positionable arrangement in combination with a wall opening, wherein said opening is formed in a vertical wall and comprises a pair of openable closure members, said arrangement comprising:

a track structure extending across a top of the opening and spaced outwardly from said vertical wall, said track structure comprising only:

a first elongated track, said track having opposite ends and a first elongated slot extending between the opposite ends thereof, a second elongated track, said second elongated track having opposite ends and a second elongated slot extending between the opposite ends thereof, said first and second elongated slots being disposed substantially parallel to and spaced from one another by a first distance, a first transverse track, said first transverse track having a first transverse slot formed therein open to and extending between the first and second elongated slots formed in the first elongated track and the second elongated track, and a second transverse track, said second transverse track spaced from the first transverse track and having a second transverse slot formed therein and open to and extending between the elongated slots formed in the first and second elongated tracks, said first and second transverse slots being disposed substantially parallel to and spaced from one another by a second distance, a first cover member, said first cover member comprising:

a first bracket member, means for connecting the first cover member to the first bracket member, and first means for interconnecting the first bracket member to the track structure and for movement in the slots of the track structure, the slots enabling the first means to sequentially move the first cover member from the first elongated track simultaneously through the first and second transverse tracks to the second elongated track, and a second cover member, said second cover member comprising;

a second bracket member, second means for interconnecting the second bracket member to the track structure and for movement in the slots of the track structure independently of said first means, the slots enabling the second means to sequentially move the second cover member from the first elongated track simultaneously through the first and second transverse tracks to the second elongated track, wherein the first and second cover members are movable between a coplanar relation with one another and a covering relation with the first and second portions of the opening, and a parallel juxtaposed relation with one another and a covering relation with a portion of the opening.

* * * * *